United States Patent [19]

Endelson

[11] Patent Number: 4,595,352

[45] **Date of Patent: * Jun. 17, 1986**

[54] SINGLE-ACTION ULTRA-THIN CIGARETTE LIGHTER

[75] Inventor: Robert A. Endelson, New York, N.Y.

[73] Assignee: Microtech Associates, New York, N.Y.

[ * ] Notice: The portion of the term of this patent subsequent to May 2, 2002 has been disclaimed.

[21] Appl. No.: 691,907

[22] Filed: Jan. 16, 1985

Related U.S. Application Data

[63] Continuation-in-part of Ser. No. 442,724, Nov. 18, 1982, Pat. No. 4,517,994.

[51] Int. Cl.[4] ..... F23Q 2/16

[52] U.S. Cl. ..... 431/254; 431/253; 431/255; 431/274; 431/344

[58] Field of Search ..... 431/253–255, 431/344, 274, 277; 206/85–87; 131/178, 185, 329; D27/36, 37

[56] References Cited

U.S. PATENT DOCUMENTS

| | | | |
|---|---|---|---|
| D. 261,062 | 9/1981 | Ichikawa | D27/36 |
| 1,802,489 | 4/1931 | Wilt et al. | 431/253 X |
| 2,677,948 | 5/1954 | Gehrie | 431/254 X |
| 3,523,006 | 8/1970 | Piffath et al. | 431/344 |
| 3,608,704 | 9/1971 | Kopp | 206/87 |
| 3,976,194 | 8/1976 | Loredo | 206/87 |
| 4,250,899 | 2/1981 | Pagani | 131/329 |
| 4,517,994 | 5/1985 | Endelson | 131/329 |

FOREIGN PATENT DOCUMENTS

| | | | |
|---|---|---|---|
| 505343 | 5/1971 | Switzerland | 431/255 |
| 940610 | 10/1963 | United Kingdom | 206/87 |

*Primary Examiner*—James C. Yeung
*Assistant Examiner*—Allen J. Flanigan
*Attorney, Agent, or Firm*—Michael Ebert

[57] ABSTRACT

A single-action ultra-thin cigarette lighter in a card-like format having a taper terminating in a blade-shaped bottom edge making it possible to wedge the lighter between the corresponding faces of the inner and outer wrappers of a standard crushable cigarette pack to serve as a stiffener therefor without significant deformation of the pack. The lighter includes a narrow reservoir for liquefied gas having front and rear walls whose width approaches that of the wrapper faces and whose length is somewhat shorter, the walls being inclined to form the taper. Mounted on top of the reservoir to seal the liquefied gas therein is a similarly narrow lighter assembly that includes a spark generator, a valve having an inlet extending into the reservoir below, and a movable hollow stem which is normally held in a closed position. A push-button operated actuator, when pressed in by the user, raises the stem to open the valve and thereby release gas therefrom, and at the same time actuates the generator to produce a spark which ignites the gas.

8 Claims, 12 Drawing Figures

Fig. 1.
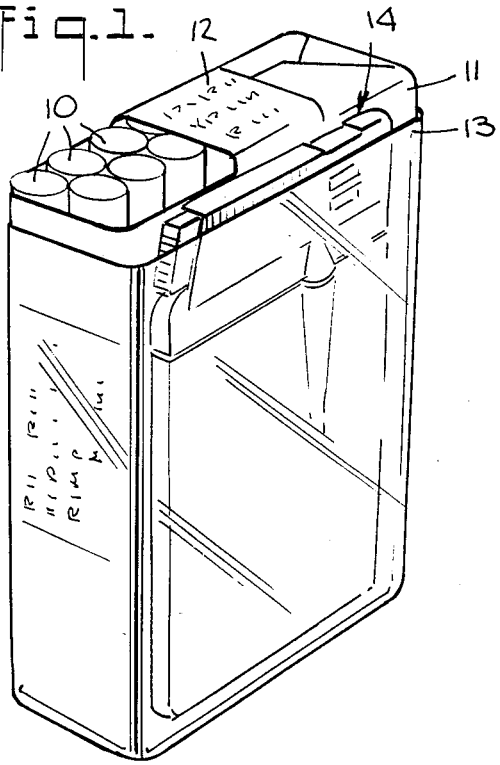
Fig. 2.
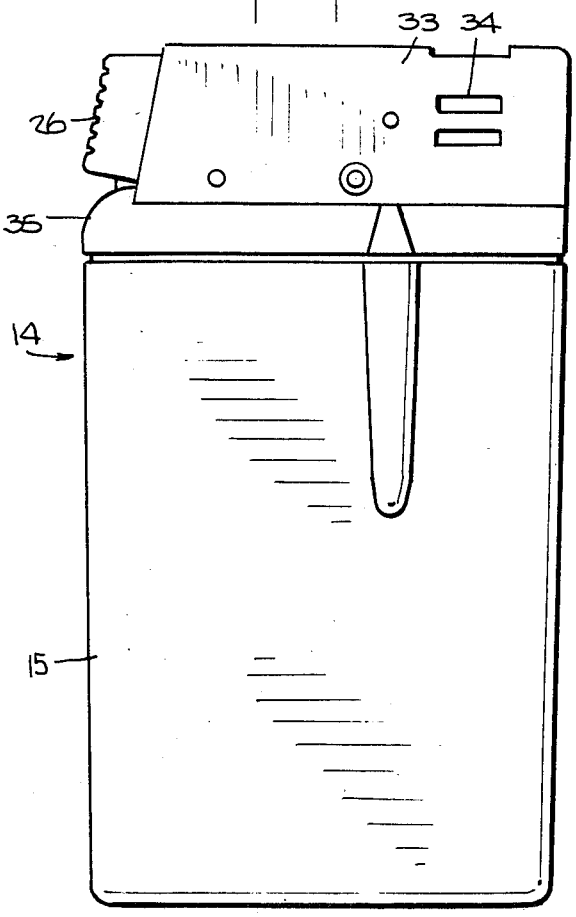
Fig. 3.
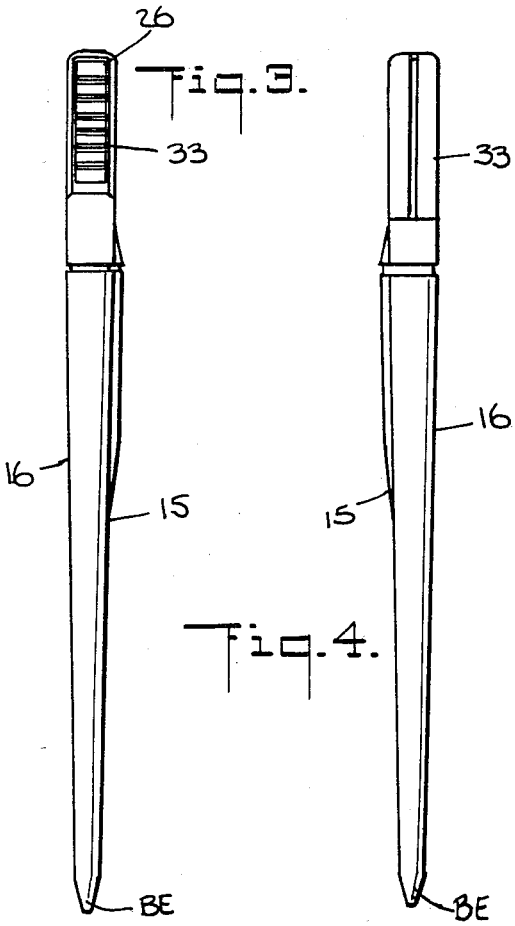
Fig. 4.
Fig. 11.
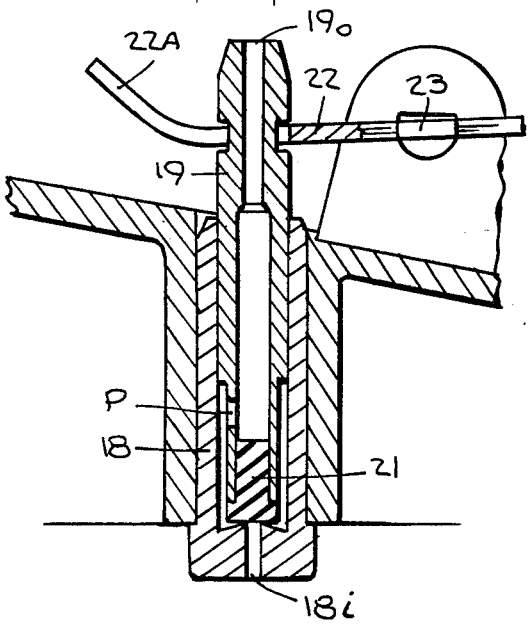

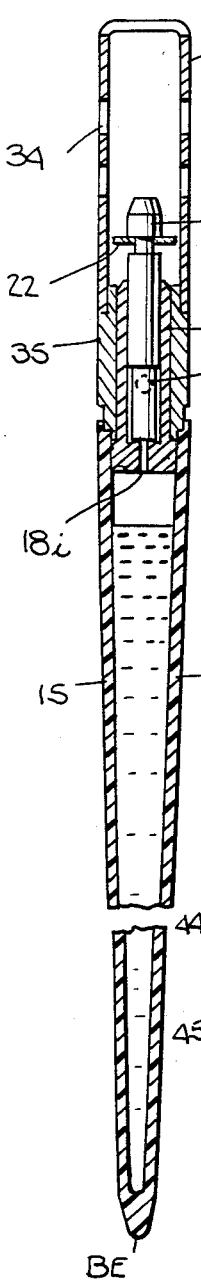
Fig. 6.
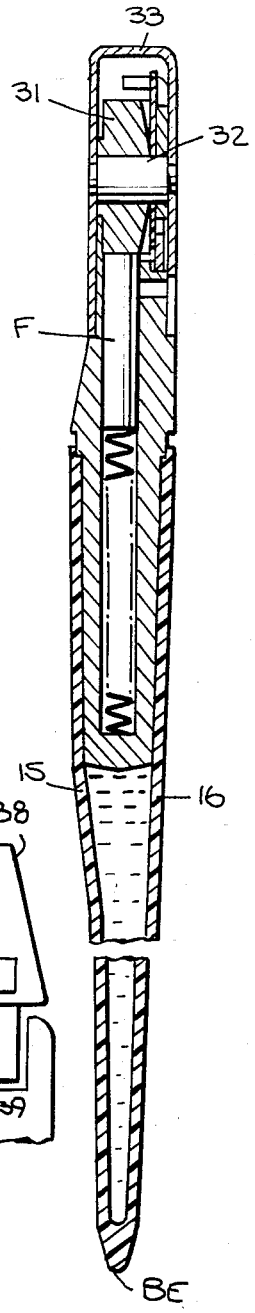
Fig. 7.
Fig. 12.
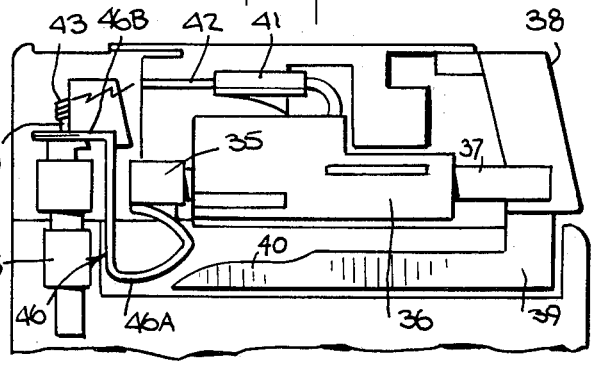
Fig. 8.
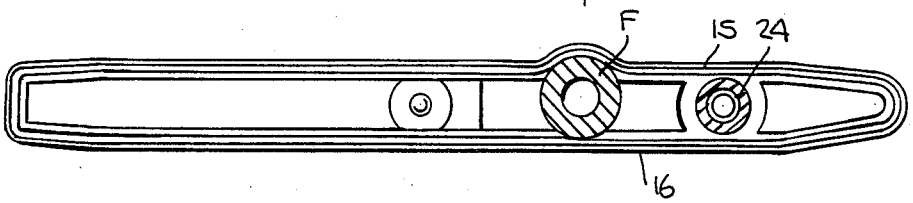
Fig. 9.
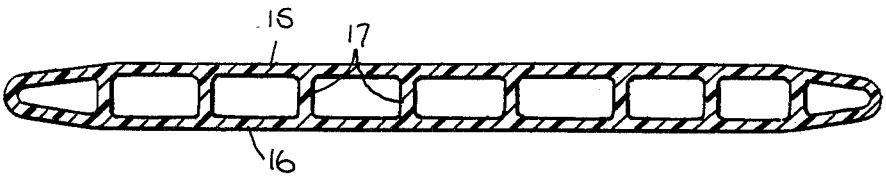

SINGLE-ACTION ULTRA-THIN CIGARETTE LIGHTER

RELATED APPLICATION

This application is a continuation-in-part of copending application Ser. No. 442,724, filed Nov. 18, 1982, entitled "Flat Cigarette Lighter", (now U.S. Pat. No. 4,517,994) whose entire disclosure is incorporated herein by reference.

BACKGROUND OF THE INVENTION

1. Field of Invention

This invention relates generally to cigarette lighters, and more particularly to an ultra-thin cigarette lighter in a card-like format having a taper terminating in a blade-shaped bottom edge which lends itself to easy insertion between the corresponding faces of the inner and outer wrappers of a standard crushable cigarette pack so that the smoker is never at a loss for a light, the flat lighter also functioning as a stiffener for the pack to prevent crushing thereof.

2. Prior Art

In the past, safety matches were usually used to light cigarettes, such matches being available in match books or match boxes. In recent years matches have largely been supplanted by cigarette lighters capable of supplying hundreds of lights before being exhausted, thereby doing away with the problems involved in striking matches and of disposing of burnt-out matches.

The modern cigarette lighter no longer uses gasoline which requires a wick, for the fuel is now a liquefied hydrocarbon mixture under pressure in a reservoir. Fuel vapor is emitted through a valve-controlled nozzle, the vapor being ignited by sparks generated by a flint abraded by a thumb wheel or by a spark produced across a spark gap to which a voltage is applied by an activated piezoelectric element. Various arrangements have been heretofore developed to permit the user of the lighter to open the gas valve as the thumb wheel is turned so as to coordinate the action of the wheel and valve or as the piezoelectric element is activated.

In the typical low-cost disposable lighter which must be discarded after the fuel is spent, the valve-actuating lever is provided with a thumb key that is placed directly adjacent the abrading thumb wheel. In this way the operator is able with his thumb to concurrently turn the wheel and depress the key to cause the valve to open to discharge vapor which is ignited by sparks generated by the abraded flint.

Existing cigarette lighters which make use of a flint or a piezoelectric element to produce sparks, are invariably relatively thick, three-dimensional structures regardless of their overall shape. Thus should the lighter have a box-like shape or take the form of a rod or cylinder, the thickness of the lighter, even in so-called slim models, is at least ⅜th of an inch and more commonly one-half inch thick.

The standard "soft" cigarette pack houses a cluster of twenty cigarettes within a paper-foil inner wrapper enveloped by a cellophane or transparent plastic-film outer wrapper. To obtain access to the contents, the smoker first uncoils a tear-off ribbon that severs the head of the outer wrapper to expose the inner wrapper which is then torn open at one side to form a port from which cigarettes can be removed.

The shape of a conventional cigarette lighter, regardless of its format, is such that the lighter must be kept separate from the pack. Thus while the usual breast pocket in a man's shirt is large enough to accommodate a cigarette pack, one cannot comfortably also accommodate the ordinary cigarette lighter. Hence, the lighter, when used by a man, is usually stored in his jacket or trouser pocket. Women tend to keep their cigarette packs and lighters loosely in handbags.

The standard cigarette pack made of foil paper and plastic film wrappers is soft and compressible, and is therefore easily crushed when subjected to pressure which may deform or mutilate the contents. Because such crushing is a fairly common experience, some smokers acquire rigid cases to store their soft packs. But crushing is by no means the only problem, for what often happens is that the smoker, after using his lighter, will forget to return it to his pocket or wherever he normally stores the lighter. He may lay it on a table or some other place and then when he later wishes to light up, the smoker may not be able to find his lighter.

One prior solution to this common problem is that disclosed in the Sanchez U.S. Pat. No. 2,998,716 in which a watch-shaped lighter is strapped onto the wrist. Apart from the practical difficulty of using the lighter at a wrist position is the fact that it pre-empts space normally occupied by a wristwatch.

The Leibow U.S. Pat. No. 2,782,910 suggests another solution. This patent discloses a special mounting to support both a cigarette pack and a lighter, the mounting serving as a rigid support for the pack. The hinged cover of the mounting houses a cigarette lighter mechanism. This special mounting is relatively elaborate and costly.

In the Pagani U.S. Pat. No. 4,250,899, the compact lighter disclosed therein has a side clip and is so dimensioned that it may be clipped onto one side of a cigarette pack, thereby adding substantially to the width of the pack. This precludes its insertion in the confines of a shirt pocket. However, by removing cigarettes from the pack, one can create a cavity therein to receive the lighter when it is then reversely clipped onto the pack. The German Pat. No. 2,301,984 to Reege shows a hard cigarette pack with an edge pocket adapted to receive a cigarette lighter. The resultant oversize pack cannot be stored in a shirt pocket.

My above-identified copending application discloses a gas-fueled ultra-thin cigarette lighter in a card format which lends itself to insertion between the corresponding faces of the inner and outer wrappers of a standard crushable cigarette pack so that the smoker is never at a loss for a light and the inserted lighter functions as a stiffener to prevent crushing of the pack.

The lighter in my copending application is constituted by a card-like body having a shallow reservoir therein filled with liquefied gas. Fitting into a corner cut-out in the body is a lighter assembly whose thickness is no greater than that of the body. The assembly includes a valve-controlled nozzle coupled to the reservoir and an adjacent thumb wheel against which a flint is pressed such that when the wheel is turned it abrades the flint to generate sparks that ignite vapor emitted from the nozzle.

In the lighter assembly disclosed in my prior patent application, in order to operate the lighter one must first lift a normally-closed cowl which is operatively coupled to the valve so that when the cowl is lifted, the valve is opened to release gas. One must then operate the thumb wheel engaged by a flint to generate sparks for igniting the gas. Thus the user is required to carry out two actions in sequence to produce a light.

SUMMARY OF INVENTION

In view of the foregoing, the main object of this invention is to provide a single-action ultra-thin cigarette lighter in a card-like format having a taper terminating in a blade-shaped bottom edge which lends itself to easy insertion between the inner and outer wrappers of a standard cigarette pack so that the dimensions of the combined pack and lighter are not perceptibly greater than those of the pack in the absence of the lighter.

Among the advantages of a cigarette lighter in accordance with the invention are the following:

A. The smoker is never at a loss for a light and he cannot misplace his light, for the lighter is where the cigarettes are, and when the smoker reaches for a cigarette he then has access to the lighter;

B. Because of the taper, the inserted lighter wedges into the package and cannot fall out;

C. The combined pack and lighter may be snugly stored in a shirt pocket or any other place whose confines are such that it can normally only comfortably accommodate a standard cigarette pack;

D. The flat cigarette lighter acts as a stiffener to prevent crushing of the otherwise soft pack; and E. The lighter is easy to operate, for it requires only a single action on the part of the user.

Also an object of the invention is to provide a disposable liquefied fuel lighter in a card-like format which may be mass-produced and sold at low cost, the lighter satisfying safety requirements for such lighters.

Briefly stated, these objects are attained in a single-action ultra-thin cigarette lighter in a card-like format having a taper terminating in a blade-shaped bottom edge making it possible to wedge the lighter between the corresponding faces of the inner and outer wrappers of a standard crushable cigarette pack to serve as a stiffener therefor without significant deformation of the pack. The lighter includes a narrow reservoir for liquefied gas having front and rear walls whose width approaches that of the wrapper faces and whose length is somewhat shorter, the walls being inclined to form the taper.

Mounted on top of the reservoir to seal the liquefied gas therein is a similarly narrow lighter assembly that includes a spark generator, a valve having an inlet extending into the reservoir below, and a movable hollow stem which is normally held in a closed position. A push-button operated actuator, when pressed in by the user, raises the stem to open the valve and thereby release gas therefrom, and at the same time actuates the generator to produce a spark which ignites the gas.

OUTLINE OF DRAWINGS

For a better understanding of the invention as well as other objects and further features thereof, reference is made to the following detailed description to be read in conjunction with the accompanying drawings, wherein:

FIG. 1 illustrates in perspective the combination of a standard cigarette pack and one preferred embodiment of a gas-fueled lighter in accordance with the invention;

FIG. 2 is an elevational view of the lighter;

FIG. 3 is a view of the lighter at one edge thereof;

FIG. 4 is a view of the lighter at the other edge;

FIG. 6 is a section taken in the plane indicated by line 6—6 in FIG. 5;

FIG. 7 is a section taken in the plane indicated by line 7—7 in FIG. 5;

FIG. 8 is a section taken in the plane indicated by line 8—8 in FIG. 5;

FIG. 9 is a section taken in the plane indicated by line 9—9 in FIG. 5;

Figure 5:
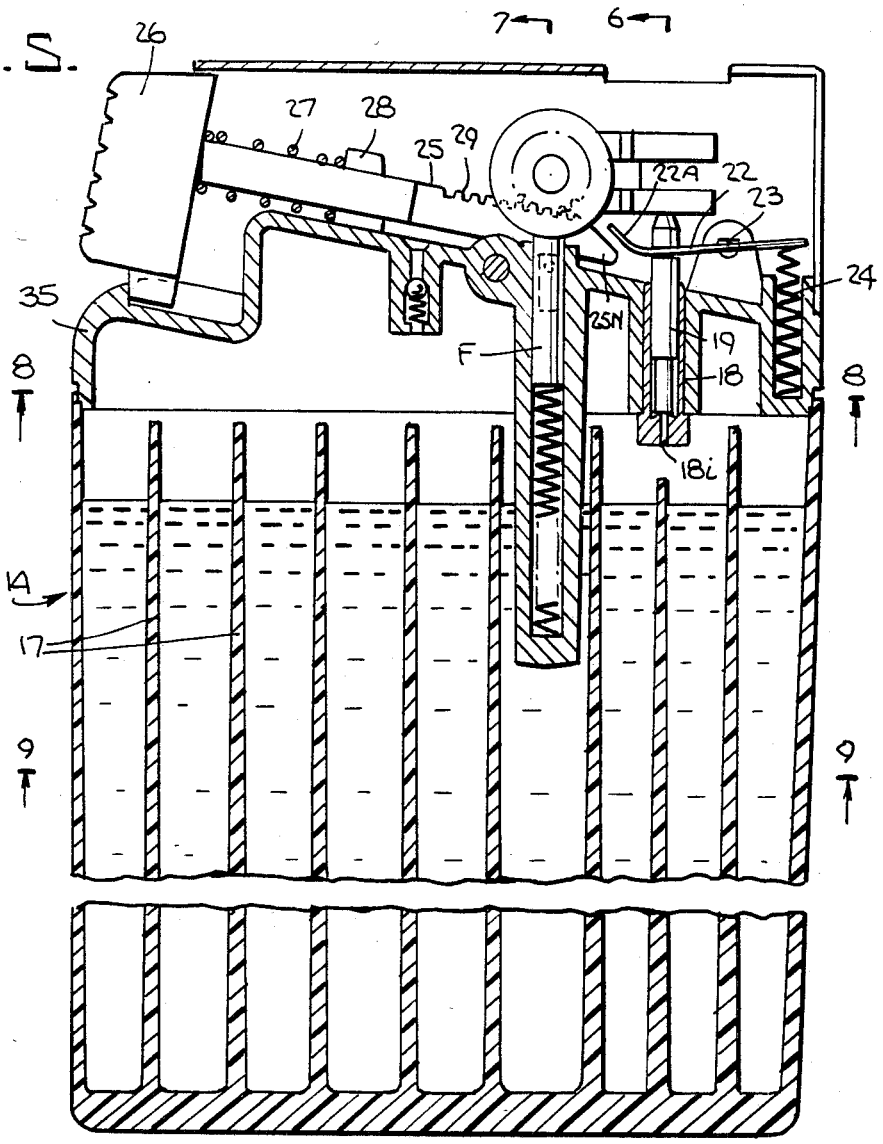
FIG. 5 is a longitudinal section taken through the lighter.
Figure 10:
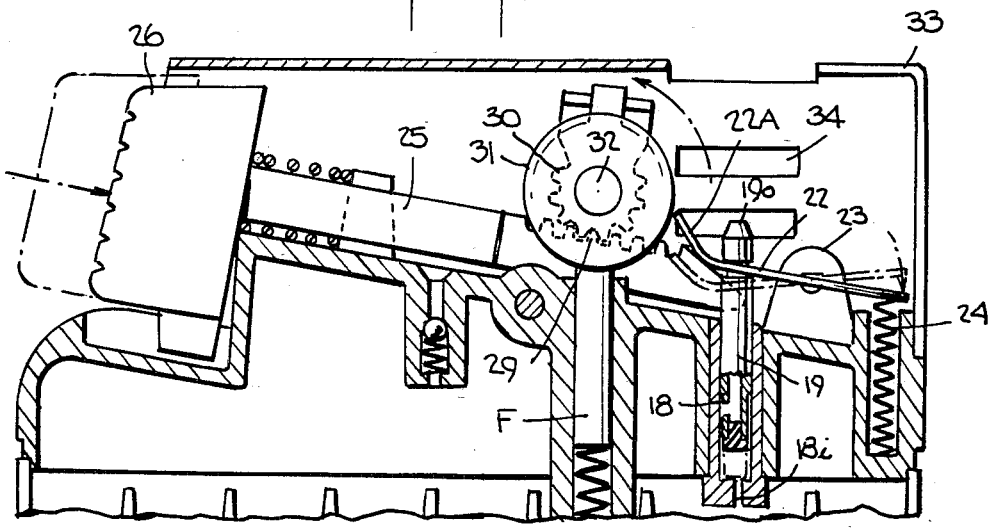

FIG. 10 separately illustrates the push-button actuator bar mechanism of the lighter;

FIG. 11 separately shows the lighter assembly valve; and

FIG. 12 illustrates, in side view, a piezoelectric type lighter assembly in another embodiment of the invention.

DESCRIPTION OF INVENTION

First Embodiment:

Referring now to FIG. 1 there is shown a standard cigarette pack for housing the usual cluster 10 of twenty cigarettes. The pack is constituted by a paper-foil inner wrapper 11 whose upper end has a transverse sealing band 12. The inner wrapper is enveloped by a cellophane or transparent plastic film outer wrapper 13 which hermetically seals the pack to prevent the loss of moisture from the cigarettes.

To break open the outer wrapper and provide access to the contents of the pack, the outer wrapper includes a tear-off ribbon (not shown) which encircles the wrapper. When the ribbon is uncoiled it decapitates the head of the outer wrapper to expose the inner wrapper. Then by tearing off the top portion of the inner wrapper 11 between band 12 and one side of the pack, a port is formed from which cigarettes can be withdrawn.

Wedged between one rectangular face of inner wrapper 11 and the corresponding face of outer wrapper 13 is an ultra-thin cigarette lighter, generally designated by numeral 14. The lighter is in a card-like format. Thus the width of the lighter approaches that of the wrapper faces and its length is somewhat shorter than that of the faces, the thinness of the lighter being such as to avoid significant deformation of the pack when the lighter is inserted therein. The card-like lighter has a taper terminating in a blade-shaped bottom edge to facilitate insertion of the lighter between the inner and outer wrappers.

Cigarette lighter 14 includes an open top, narrow reservoir body molded of non-reactive synthetic plastic material of high strength, such as acetal resin or polycarbonate material, the molded body having rectangular front and rear walls 15 and 16. These walls, as shown in FIGS. 3 and 4 and FIGS. 5 and 6, are inclined toward each other so that the body is tapered and becomes progressively even thinner as one moves toward the blade-shaped bottom edge BE of the body. This tapered configuration creates a wedge which not only facilitates insertion of the lighter but also resists removal of the lighter from the cigarette pack and prevents it from falling out of the pack.

This reservoir is filled with butane, isobutane, propane or other liquefied hydrocarbon mixture whose vapor pressure at 75° F. (24° C.) exceeds an absolute pressure of 30 psi. The reservoir is narrow and the walls thereof have an area of several square inches which are exposed to a relatively high pressure per square inch. In order therefore to withstand this pressure, the front and rear walls 15 and 16 of the reservoir are joined together by an array of parallel reinforcing ribs 17 which define parallel channels, the upper ends of the ribs falling short of the top of the reservoir.

The reinforcing ribs act to prevent dilation of and possibly rupture of the walls of the reservoir by the pressure of fluid. Though the reservoir is thin, its length and width are relatively large compared to those of the reservoir included in conventional lighters. Hence, the capacity of the reservoir is comparable to that of conventional lighter reservoirs and the present lighter is therefore capable of giving hundreds of lights. When a cigarette pack is exhausted, the lighter may be transferred to a fresh pack. Alternatively, the cavity within the body may be filled with an open-cell, rigid foam plastic material such as polypropylene or polyethylene bonded to the front and rear walls 15 and 16 to form a reservoir whose cells are filled with the liquid fuel.

Mounted on top of the reservoir is a similarly-narrow lighter assembly whose body 35 is joined to the top edge of the reservoir to effect hermetic sealing thereof. As shown separately in FIG. 11, the assembly includes a cylindrical valve body 18 having an inlet $18_i$ at its lower end which extends into the reservoir to admit the gas. Axially slidable within valve body 18 is a hollow stem 19 whose upper end acts as the valve nozzle or outlet 19. The stem has, below a lateral port P, a valve seat 21 which in the down position of the stem, blocks the flow of gas admitted into the inlet.

Also provided is a lever 22 pivoted on a fulcrum 23 and engaging the exterior of the stem 19 at a constriction thereon under its outlet $19_o$. Lever 22 is biased at its right end by a helical spring 24 which acts to swing the lever counterclockwise to hold the valve stem at its down or closed position.

The left end of the lever is curved upwardly to form a lever operator 22A. This bend is engaged by a nose 25N at one end of a slidable actuator bar 25 having at its other end an exposed push-button 26 which is adjacent the left end of the lighter assembly. A spring 27 is coiled about the bar between the push button and a bar guide 28, the spring acting to hold the bar in its inactive position in which nose 25N is displaced from lever operator 22A.

When, however, the push-button is pressed in by the user to slide the bar inwardly, this causes nose 25N to engage lever operator 22A and swing the lever in the clockwise direction, thereby lifting valve stem 19 to open the valve to release gas from the valve outlet 19.

Formed along the upper edge of actuator bar 25 is a rack 29. As shown in FIG. 10, rack 29 is engaged by a pinion 30 mounted on an axle 32 supporting an abrading wheel 31, the axle being transverse to the plane of the lighter assembly. When the actuator bar is pushed in, rack 29 then rotates the pinion, which, through a one-way clutch (not shown), turns wheel 31 in the same direction. When the actuator bar thereafter returns to its initial position under the urging of spring 27, the wheel does not then turn.

Thus when the push button is operated by the user, this action not only serves to open the valve to release gas, but it also acts to turn wheel 31 which abrades a flint F to generate sparks to ignite the released gas. In operation, therefore, a single push-button action is all that is necessary to produce a light for a cigarette removed from the pack. The lighter may then be returned to the pack for subsequent use. The lighter assembly is provided with a wind guard 33 having slots 34 in the region above the valve outlet, as shown in FIG. 2.

Second Embodiment:

In the embodiment of the lighter shown in FIG. 12, use is made of a shorter generator that employs a piezoelectric element rather than a flint and an abrading wheel as in the first embodiment. In all other respects in terms of dimensions and functions, the piezoelectric lighter assembly corresponds to the assembly included in the first embodiment.

In FIG. 12, the assembly comprises a piezoelectric element 35 which is excited by a trigger action mechanism 36 of the type found in conventional lighters of this type. Mechanism 36 is coupled by a plunger 37 to the manually-operated button 38 of an actuator 39 which is in the form of a bar terminating in a curved nose 40.

One terminal of piezoelectric element 35 is connected through a resistor 41 to a wire electrode 42. Surrounding the hollow metal stem 44 of the fuel valve 45 which extends into the fuel reservoir is a coil electrode 43. This is spaced from electrode 43 to define a spark gap. The valve stem 44 which is in a normally closed position is axially lifted to open the valve by means of a shaped flat metal spring 46 whose upper right angle section 46A engages stem 44 and whose lower crooked section 46B engages and makes electrical contact with the other terminal of of piezoelectric element 35.

Thus one terminal of this element is connected to wire electrode 42 via resistor 41 and the other terminal is connected to coil electrode 43 via spring 46 and valve stem 44 whereby the high voltage developed by the piezoelectric element is applied to the electrodes.

When the user presses button 33 in, this causes trigger mechanism 36 to fire, the mechanism physically striking piezoelectric element 35 to produce a high voltage which is applied to electrodes 42 and 43 to cause a spark to jump across the gap therebetween. At the same time, the curved nose 40 of the actuator bar 36 which is pushed forward when button 33 is pressed in, engages and deforms the crooked section 46B of the spring, this action causing the spring 46 to raise its upper section 46A and thereby lift the valve stem 44 to open the valve to emit fuel gas which is ignited by the spark. Thus the piezoelectric lighter assembly is of the single action type.

While there has been shown and described a preferred embodiment of a single-action ultra-thin cigarette lighter in accordance with the invention, it will be appreciated that many changes and modifications may be made therein without, however, departing from the essential spirit thereof. Thus, instead of a lighter which is disposable, the lighter may be of the refillable type in which when the supply of butane is exhausted, the butane reservoir may be refilled by the user.

I claim:

1. A cigarette lighter in an ultra-thin card-like format for inse-tion between the corresponding front or rear rectangular faces of the inner and outer wrappers of a standard, crushable cigarette pack without significant distortion thereof, said lighter comprising:

(A) an open-top narrow reservoir filled with liquefied gas and having a width close to that of said rectangular faces and whose length is somewhat shorter than that of said rectangular faces, said reservoir having front and rear walls which are inclined to create a taper terminating at the bottom edge of the reservoir which is blade-shaped, making it possible to wedge the lighter between said faces; and (B) a similarly narrow lighter assembly mounted on top of the reservoir to seal the liquefied gas therein, said assembly including a spark generator, a normally closed valve having an inlet extending into the reservoir to admit gas therefrom into a hollow stem having an outlet adjacent the spark generator, and manually-operated means to actuate the generator to produce a spark and to open the valve to emit gas from the outlet to be ignited by the spark.

2. A lighter as set forth in claim 1, wherein said reservoir is molded of synthetic plastic material.

3. A lighter as set forth in claim 2, wherein said reservoir includes molded reinforcing ribs joined to said front ad rear walls to resist the pressure of the gas.

4. A lighter as set forth in claim 1, wherein said spark generator is formed by an abrading wheel whose underside is engaged by a flint.

5. A lighter as set forth in claim 4, wherein said means is constituted by a push-button operated actuator which when pushed in, simultaneously activates the generator and opens the valve.

6. A lighter as set forth in claim 1, wherein said spark generator includes a piezoelectric element which when activated by a trigger mechanism produces a high voltage which is applied to spark-gap electrodes.

7. A lighter as set forth in claim 6 wherein said means is constituted by a push button-operated actuator which when pushed in, simultaneously operates the trigger mechanism and opens the valve.

8. A lighter as set forth in claim 1 wherein said walls are joined by spaced ribs which act to resist the pressure produced by said gas.

* * * * *

UNITED STATES PATENT OFFICE

CERTIFICATE OF CORRECTION

Patent No. 4,595,352 Dated June 17, 1986

Inventor(s) Robert A. Endelson

It is certified that error appears in the above-identified patent and that said Letters Patent are hereby corrected as shown below:

Column 6, line 54, change "inse-tion" to -- insertion --

Column 7, line 11, change "ad" to -- and --

Signed and Sealed this

Seventh Day of October, 1986

[SEAL]

*Attest:*

DONALD J. QUIGG

*Commissioner of Patents and Trademarks*

*Attesting Officer*